US005441702A

United States Patent [19]

Lemieux et al.

[11] Patent Number: 5,441,702

[45] Date of Patent: Aug. 15, 1995

[54] REFILL PACK FOR PIPETTE TIP RACKS

[75] Inventors: David J. Lemieux, Middleton, Mass.; Paul K. Chadwick, San Francisco, Calif.; Christopher Kelly, Larkspur, Calif.; James S. Petrek, Danville, Calif.; Kenneth Rainin, Piedmont, Calif.; Haakon T. Magnussen, Jr., Orinda, Calif.; William D. Homberg, Oakland, Calif.

[73] Assignee: Rainin Instrument Co., Inc., Emeryville, Calif.

[21] Appl. No.: 125,019

[22] Filed: Sep. 21, 1993

[51] Int. Cl.[6] ..... B01L 3/02; B65D 55/00; B65D 1/34

[52] U.S. Cl. ..... 422/100; 422/104; 206/499; 206/503; 206/506; 206/507; 206/563

[58] Field of Search ..... 422/99, 100, 104; 206/562, 486, 503, 499, 506, 507, 563

[56] References Cited

U.S. PATENT DOCUMENTS

| | | | |
|---|---|---|---|
| 3,853,217 | 12/1974 | Scordato et al. | 206/223 |
| 3,937,322 | 2/1976 | Cohen | 206/216 |
| 4,349,109 | 9/1982 | Scordato et al. | 206/562 |
| 4,520,946 | 6/1985 | Gould et al. | 221/63 |
| 4,577,760 | 3/1986 | Rainin et al. | 206/508 |
| 4,936,152 | 6/1990 | Aldred | 73/863.32 |
| 4,963,493 | 10/1990 | Daftsios | 435/287 |
| 5,057,282 | 10/1991 | Linder | 422/104 |
| 5,111,939 | 5/1992 | Schafer | 206/503 |
| 5,324,482 | 6/1994 | Scaramella et al. | 422/100 |

OTHER PUBLICATIONS

Bio-Rad Laboratories, Inc. Richmond, Calif.—Nested & enclosed racks.

U.S.A./Scientific Plastics, Ocala, Fla.—Re-Pack Rack & cartridge.

*Primary Examiner*—James C. Housel
*Assistant Examiner*—Long V. Le
*Attorney, Agent, or Firm*—Robert R. Meads

[57] ABSTRACT

A refill pack for storing and dispensing pipette tips into a tip rack, comprising a support plate with an array of holes containing disposable pipette tips arranged in an organized array and a carrier for hand positioning the support plate over the tip rack for release of the array of pipette tips into the tip rack.

29 Claims, 10 Drawing Sheets

REFILL PACK FOR PIPETTE TIP RACKS

FIELD OF INVENTION

The present invention relates to the refilling of pipette tip racks and, more particularly to a disposable refill pack of pipette tips for reusable pipette tip racks.

BACKGROUND OF THE INVENTION

It is the function of pipette tip racks to organize disposable pipette tips in a manner for convenient tip placement on a pipette. Such racks generally comprise a base with vertical sides joined at contiguous edges and containing supports for a rigid horizontal tray or support plate containing an array of holes for vertically receiving and supporting a horizontally spaced array of pipette tips. The pipette tips are held vertically in the array for ease of access by a pipette tip user. In this regard, the pipette tip user simply moves a hand-holdable pipette over the rack and lowers a distal end of the pipette into a proximal or upper end of a vertically oriented tip and presses down to affix the tip to the pipette. A similar operation is followed by the user when connecting a plurality of tips to a multiple tip pipette. U.S. Pat. No. 4,676,377 describes a conventional pipette tip rack of the type just described, and U.S. Pat. No. 4,779,467 describes a multiple tip pipette.

Once all tips are dispensed from the tip rack, the rack may be discarded or reloaded with a new supply of pipette tips. The reloading of disposable pipette tips into such tip racks in a rapid, convenient manner is important to pipette users. Further, any packaging containing pipette tips and for use in loading pipette tips into a tip rack should arrange the pipette tips in a manner to accommodate direct dispensing of the tips into standard tip rack arrangements. Moreover, it is important that such packaging protect the disposable pipette tips from damage and contamination during shipping, handling and storage and provide for sterilization by autoclaving or irradiation of the pipette tips. Still further, when plastic materials are utilized for such packaging, it is particularly important to the preservation of our environment (1) that the plastic material be recyclable and (2) that the packaging structure be thin, lightweight and of low mass to minimize the amount of non-biodegradable disposable material from such packaging. Furthermore, there is a need for refill packs for manually reloading reusable pipette tip racks with filter containing pipette tips such as the FilterPro of the Rainin Instrument Co., Inc., assignee of the present invention, or, such as the filter devices described in U.S. Pat. No. 5,156,811, assigned to Continental Laboratory Products, Inc. of San Diego, Calif.

Prior packaging used for stacks of pipette tip racks and for pipette tips for reloading empty pipette tip racks do not satisfy such requirements. For example, U.S. Pat. No. 3,853,217 describes a stack of stand-alone pipette tip racks, referred to in the patent as "trays". Each tray comprises a horizontally oriented rectangular support. The horizontal support contains transverse stiffening ribs. Each rib extends above the horizontal support and terminates in marginal vertical sides. The sides extend above and below the horizontal support and connect at their contiguous edges to form a skirt. The skirt extends below distal end portions of vertical pipette tips contained in a honeycomb array of openings in the horizontal surface. A shoulder is formed around the skirt so as to accept and support an identical upper tray to rest a lowermost edge of its skirt for stacking of the trays. The shoulder thereby spaces the upper tray so as to allow the distal end portion of the pipette tips in the upper tray to extend into the open proximal end of the pipette tips in the lower tray. Concentric positioning of the upper tips in the lower tips permits a nested stacking of multiple trays. A cover encloses the topmost tray in the stack. Tape is used to secure the cover and stacked trays; applied to fasten the cover and trays along common sides. Nested stacks of the trays with a cover are enclosed within a snug carton for shipping and storage. Additionally, folded sleeves are included in the shipping carton for covering a tray removed from the stack. The carton is provided with a pipette tip extractor for collecting used tips in the shipping carton. The trays are structurally rigid and with sufficient material thickness to be self supporting. The rigid trays are used individually and stored as stacked.

In use, the stacked trays with the cover taped in place are removed from the shipping carton. Individual trays are removed from the bottom of the stack by severing the tape attaching the lowest tray, leaving the upper trays attached and enclosed until the next bottom tray is to be used. The pipette tips are accessed individually from the tray, since the honeycomb arrangement does not accommodate multiple tip pipettes. Used pipette tips are disposed of in the shipping carton, using the tip extractor included. As each tray is emptied, it is discarded. Since the trays are intended for stand-alone use, their structure is necessarily heavy, with thick stiffening sections, containing a significant amount of plastic. Therefore, the heavy trays represent a significant environmental disposal problem. Further, the nesting of the trays with upper pipette tips extending into lower tips, precludes the use of the package of U.S. Pat. No. 3,853,217 for storage and dispensing of filter containing pipette tips.

In U.S. Pat. No. 3,937,322, a package containing a stack of trays of pipette tips is disclosed. Each tray comprises a horizontal rectangular support with an array of openings. The openings accept distal end portions of pipette tips and maintain their longitudinal axes in a vertical orientation. The trays are stacked in a carton by telescoping the pipette tips carried by an upper tray into the open upper ends of the pipette tips carried by the next lower tray and by resting a horizontal support lower surface of the upper tray on the upper edge of the pipette tips in the next lower tray. The lowermost tray in the stack is supported on a tray support extending vertically from a bottom of the carton. Also attached to the carton is a pipette tip extractor.

In use, the carton is opened at the top and uppermost pipette tip trays are exposed. The pipette tips are accessed from the open top of the carton and individually loaded onto pipettes. This is accomplished by pressing an end of a pipette into a tip to seat the tip thereon and then by removing the loaded pipette from the carton. When all the pipette tips on the uppermost tray have been thus dispensed from the tray, the tray is discarded, exposing the tips in the tray below. The pipette tip extractor is installed in a wall of the carton and permits a used tip to be extracted from the pipette and dropped into the carton without contact with the user. The carton is then used for disposal of used tips.

As described, the container of U.S. Pat. No. 3,937,322 is characterized by a number of shortcomings. Because of the telescoping of the pipette tips in the stack of trays, it is not possible to use the packaging of the '322 patent for the storage and dispensing of filter containing tips. Further, for one of the contained pipette tips to be accessible to a user for reloading of a pipette, substantially all the contained pipette tips are exposed to the atmosphere and hence subject to possible contamination. Finally, each tray is supported on the tops of the pipette tips in the next lower tray. Unless the trays and the bottom tray support are formed of relatively heavy, rigid plastic or equivalent material, the downward pressing of the pipette in loading a tip onto the shaft of a pipette will produce an undesired downward bowing of the trays. The bowing of the tray makes it difficult to insert a pipette onto the end of a pipette shaft. In the case of a multiple-tip pipette, only a small amount of bowing is required to prevent a user from being able to insert pipette tips simultaneously onto all shafts of the multiple-tip pipette simply by pressing down on the pipette. Rather, if the tray bows, a user must (i) check each tip individually in order to assure that all tips are properly secured to each pipette shaft and (ii) secure any loose tips individually by hand. With a heavier, more rigid rack support, such bowing will not occur. However, if the trays and the bottom tray support are formed of a heavy rigid plastic material to prevent such undesired bowing during the loading of pipettes, then the disposal of such trays will present an undesired increase in the disposal of non-biodegradable materials.

Prior commercially available packaging of stacks of nested pipette tip racks similar to the packaging disclosed by the U.S. Pat. No. 3,853,217 and possessing all the disadvantages thereof is represented by the RBR Packaging of Bio-Rad Laboratories, Inc. of Richmond, Calif. TBR Packaging comprising a stack of separate racks is also available from Bio-Rad Laboratories, Inc. In addition, USA/Scientific Plastics of Ocala, Fla. markets a RE-PACK RACK comprising a reusable pipette tip rack, designed to accept RE-PACK Tray Cartridges preloaded with 192 pipette tips per tray. Once a tray is empty, it is simply removed from the rack and discarded and another tray cartridge inserted in its place. The RE-PACK Tray Cartridges are formed of a rigid, relatively heavy plastic construction and, but for the transverse ribs, resemble and possess the disadvantages of the trays disclosed in U.S. Pat. No. 3,853,217. Such RE-PACK tray cartridges are available in shrink-wrapped stacks of 5 trays of 192 tips each.

From the foregoing, it should be appreciated that prior packages for pipette tip racks and trays do not satisfy the previously stated desired requirements for packaging for reloading of disposable pipette tips into reusable tip racks. Thus, there is a continuing need for such packaging which is satisfied by this present invention.

SUMMARY OF THE INVENTION

In its most basic form, the present invention provides a simple, light weight, low cost and disposable or recyclable refill pack for reusable pipette tip racks in which pipette tips are contained with their longitudinal axes vertically positioned in a horizontally spaced pattern or array. The refill pack comprises (i) a horizontally extending pipette tip organizing and support plate, (ii) a light weight hand-gripable support plate carrier, and (iii) manually releasable means for dispensing pipette tips from the refill pack into an empty tip rack. The support plate includes an array of holes for vertically receiving and organizing pipette tips in a desired pattern for deposit into and containment within an empty tip rack. Distal end portions of the pipette tips extend vertically through the holes on one side of the support plate while proximal end portions of the pipette tips are supported by the plate on an opposite side thereof. The carrier is secured to the support plate and enables a user to manually move and position the support plate over an empty tip rack while the support plate maintains the horizontal spacing and vertical orientation of the pipette tips within the refill pack ready for dispensing into the tip rack upon a release of the tips from the refill pack.

Preferred embodiments are presented setting forth details referred to and illustrated in the drawings described below. The variations of the invention hereinafter described may be embodied as a single or multiple stacked array refill packs and may include a pipette tip rack.

DESCRIPTION OF THE PREFERRED EMBODIMENTS

The present invention provides a novel refill pack of disposable pipette tips for reusable pipette tip racks and may take any of a multiplicity of forms within the claims hereafter presented. Each embodiment may include or exclude a tip rack as part of the refill pack. Additionally, the materials for use in the present invention may be selected as appropriate for sterilization by autoclaving or irradiation and to permit recycling for minimizing detrimental environmental impact.

Figure 1A:
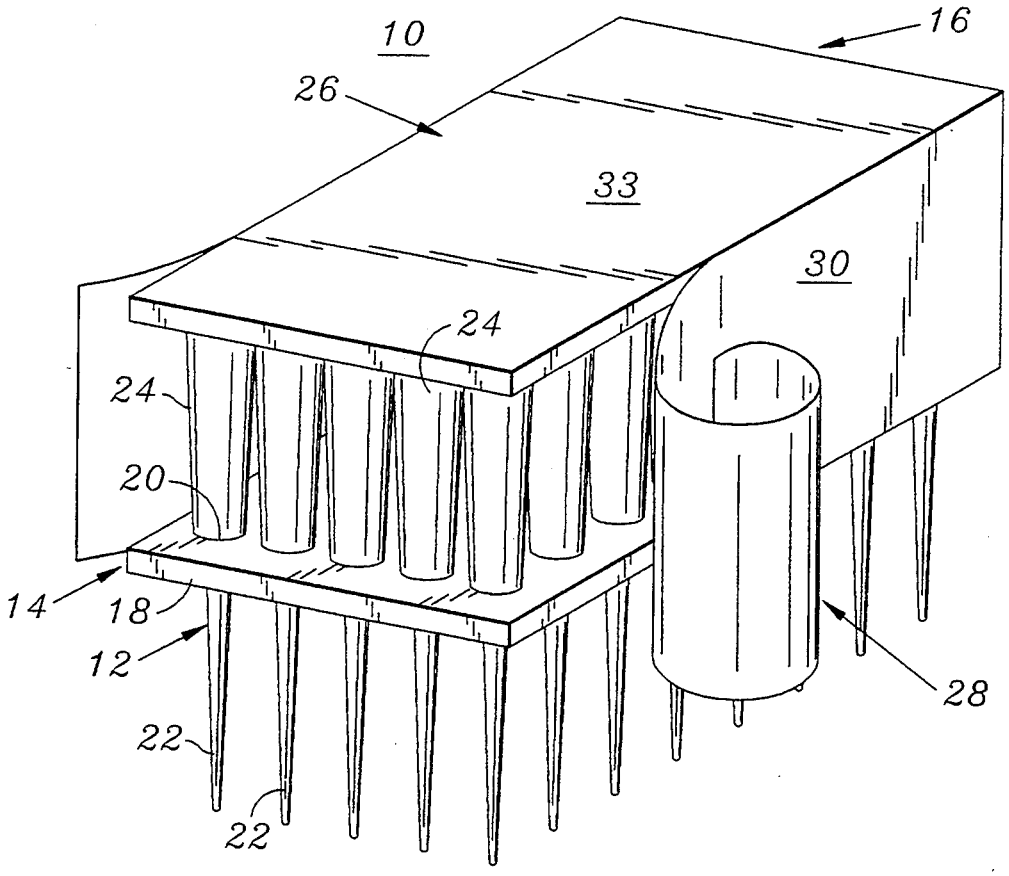
FIG. 1*a* is an isometric view of a basic and simple embodiment of a single array pipette tip refill pack showing the use of tape as releasable means for releasably securing a support plate for an array of pipette tips to a carrier comprising a cover or top plate for the array.

More particularly, a simplified form of a single array refill pack 10 is shown in FIG. 1*a* and comprises a pipette tip organizing means 14 for an array of pipette tips 12 in combination with a hand gripable carrier 16 for the organizing means 14.

As illustrated, the organizing means 14 comprises a semi-rigid plastic support plate 18 having an array of holes 20 for (i) receiving distal end portions 22 of the pipette tips 12 and (ii) organizing the pipette tips 12 into a horizontally spaced array. The array of pipette tips 12, which may comprise filter containing pipette tips, has distal end portions 22 extending perpendicularly through the holes 20 in the support plate 18 and proximal end portions 24 extending perpendicularly from the opposite surface of the support plate 18.

As also illustrated in the embodiment of FIG. 1*a*, the carrier 16 comprises a cover 26 secured by releasable means 28 to the support plate 18. The illustrated cover 26 comprises an alignment plate 33 which rests on and confines the proximal end portions 24 of the pipette tips 12 in combination with the support plate 18.

The releasable means 28 of FIG. 1*a* comprises a tape 30 of sufficient vertical dimension and length to extend between and around and to adhesively, thermally or mechanically attach to marginal edges of the support plate 18 comprising the organizing means 14 and marginal edges of the alignment plate 33 comprising the carrier 16.

Figure 2A:
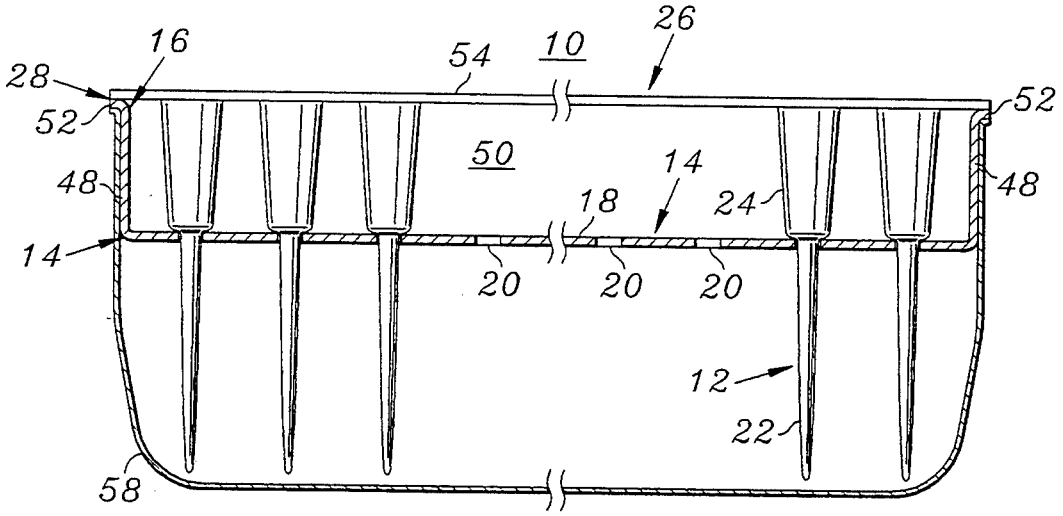
FIG. 2*a* is a shortened longitudinal section side view of another embodiment of a single array refill pack having a flanged support plate and a planar cover plate, and showing a protective pouch covering distal end portions of the pipette tips.
Figure 2B:
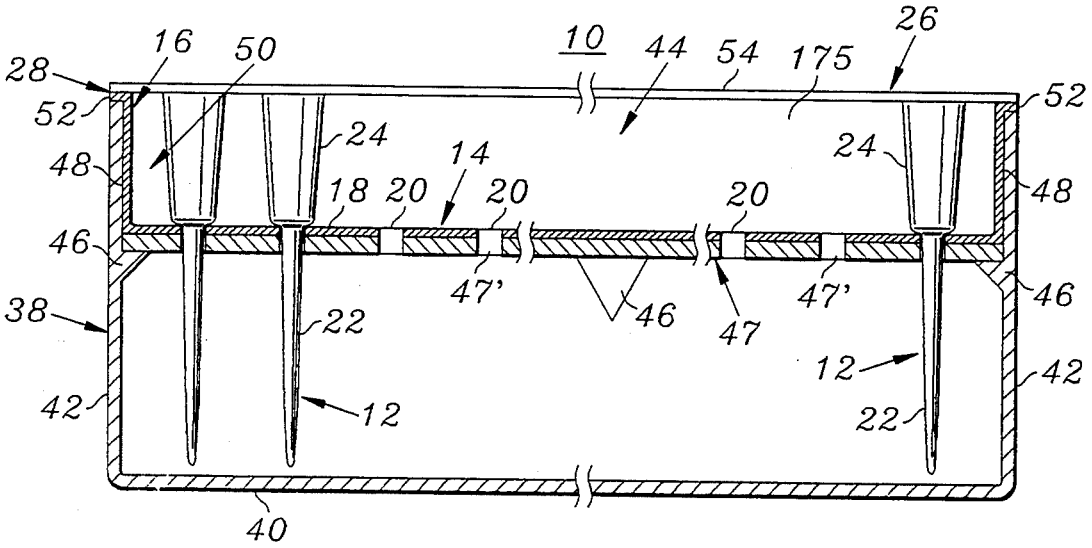
FIG. 2*b* is a shortened longitudinal section side view showing the embodiment of FIG. 2*a* with the pouch removed and the support plate in place on a tip rack.

To protect the distal end portions 22 of the array of pipette tips 12 and to complete the packaging for the refill pack 10, the refill pack may be enclosed by shrink wrap or within a pouch or other container or box of a thin light weight recyclable plastic or cardboard material. Then, in use, the refill pack is removed from the shrink wrap, pouch or box. Next, the user of the refill pack grips the alignment plate 33 and moves the pack 10 over the top of any empty tip rack, such as 38 in FIG. 2*b*. He inserts the distal end portions of the array of pipette tips 12 into the open top of the rack and releases the tape 30 to deposit the tips and support plate 18 in the rack. The alignment plate 33 is removed and may be recycled, as may the support plate after all of the pipette tips are dispensed from the rack.

Figure 1B:
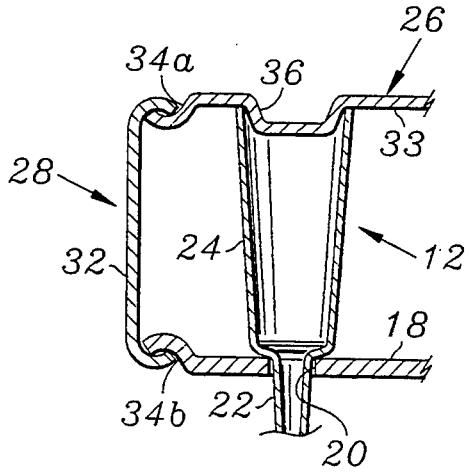
FIG. 1*b* is a partial section end view of the single array of FIG. 1*a* with the tape replaced by side clips. Also, downwardly extending truncated conical projections comprising pipette tip indexing means are included in the cover plate to laterally constrain proximal end portions of pipette tips and to maintain the longitudinal axes of the tips in a vertical orientation.

An alternate form of the refill pack 10 is shown in FIG. 1*b*. As illustrated, instead of comprising a length of tape, the releasable means 28 comprises plastic or metal spring clips 32 or other spring attachment means, releasably securing the carrier 16 and the support plate 18. In the illustrated alternative, the alignment plate 33 includes a downwardly extending marginal channel **34*a* formed so as to accept the spring clip 32 with its uppermost surface flush with the upper surface of the alignment plate 33. Similarly, to accept the lower portion of the spring clip 32, the support plate 18 contains an upwardly extending marginal channel 34b formed so as to retain the spring clip lowermost surface flush with the lower surface of the support plate 18**.

In addition, in the alternative form of the refill pack illustrated in FIG. 1*b*, an array of frusto-conical projections 36 extend downwardly from a bottom of the alignment plate 33. The array of projections 36 correspond to and align vertically with the array of holes in the support plate 18 and define indexing means extending into and laterally constraining proximal end portions 24 of pipette tips 12 to maintain the longitudinal axes of the pipette tips 12 in a vertical orientation.

In use, the spring clips 32 releasably secure the support plate 18 relative to the alignment plate 33 whereby a manual positioning of the support plate 18 over a pipette tip rack 38 with the distal end portions 22 of the pipette tips 12 extending into the pipette tip rack 38 followed by a release of the spring clips and removal of the alignment plate 33 affects a refilling of the pipette tip rack.

Figure 1C:
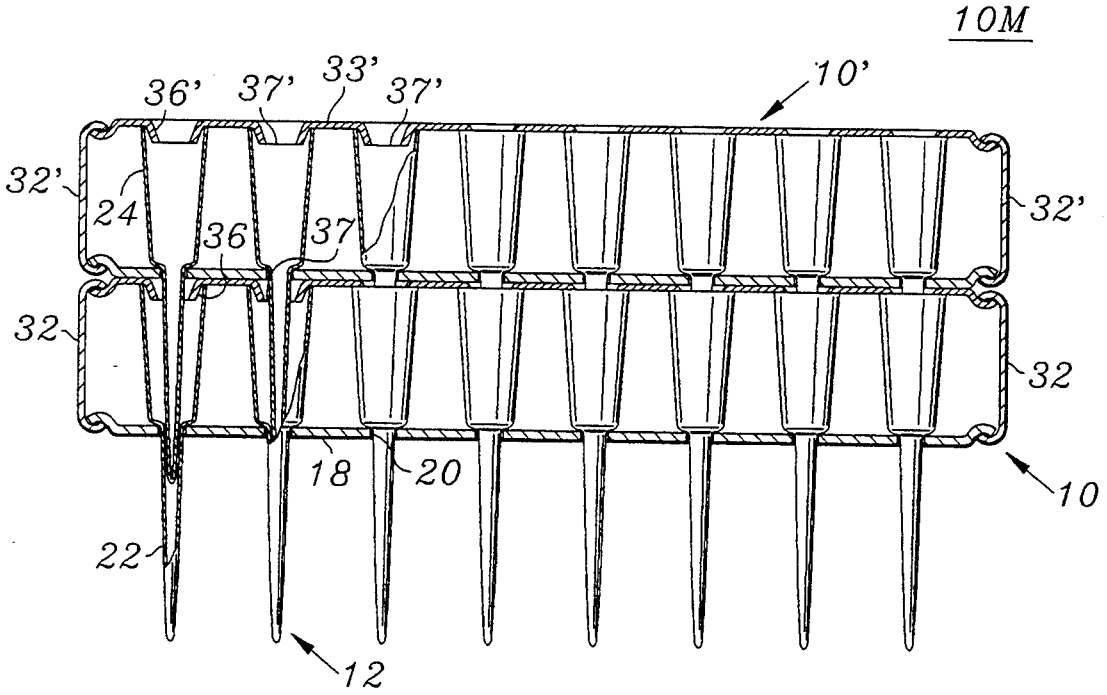
FIG. 1*c* is a full section end view of two stacked and nested single array packs similar to FIG. 1*b*, showing partial cutaways of pipette tips to illustrate a nesting of distal end portions of an upper array of pipette tips through openings in the indexing means and into proximal end portions of a lower array of pipette tips.
Figure 1D:
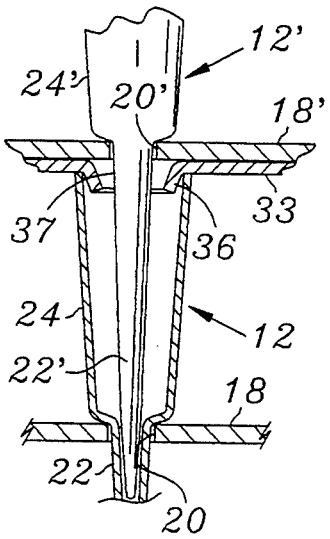
FIG. 1*d* is an enlarged partial section of nested pipette tips of FIG. 1*c* more clearly illustrating the use of fluted openings in the indexing means of the cover plate, the fluted opening corresponding to and being aligned with the openings in a support plate to impart lateral stability to pipette tips and to permit a multiplicity of individual pipette tip array packs to be stacked in a space efficient manner.

As shown in FIGS. 1*c* and 1*d*, the basic refill pack 10 of the present invention may be modified to accommodate a stacking of similar refill packs 10 and 10' with a nesting of arrays of conventional pipette tips into a space saving package. To accomplish such stacking, the alignment plate 33 comprising the carrier 16 for the refill pack 10 may include an array of holes 37 corresponding to the array of holes 20 in the support plate 18. As shown most clearly in FIG. 1*d*, when the refill pack includes the indexing means extending from the alignment plate 33, the holes 37 may comprise open ends of the frusto-conical projections 36. As illustrated, the holes 37 are dimensioned such that when a second refill pack 10' is stacked on the refill pack 10, the support plate 18' of the second pack rests on a top of the alignment plate 33. Thus arranged, the distal end portions 22' of an array of pipette tips 12' carried by the support plate 18' extend through corresponding ones of the holes 37 in the alignment plate 33 and nest into corresponding proximal and distal end portions of corresponding ones of the pipette tips 12. In this process, the frusto-conical indexing means provide vertical guiding and lateral support for the distal end portions of the pipette tips 12' into proximal end portions of the pipette tips 12, to form a compact multiple array refill pack 10M.

As with the single array refill pack 10, the multiple array refill pack 10M may be protected in a shrink wrap, pouch or box during shipping or storage. Then, in use, the multiple array refill pack is removed from the shrink wrap, pouch or box. The user then grips the alignment plate 33' of the refill pack 10' and lifts the pack 10' from the pack 10. The operation of reloading an empty tip rack with the refill rack 10' is then the same as previously described for the pack 10.

Another embodiment of the refill pack of the present invention is shown in FIGS. *2a* and *2b* for and in use with a pipette tip rack 38. Generally speaking, as in the embodiment of FIGS. *1a* through *1d*, the refill pack 10 of FIGS. *2a* and *2b* comprises (1) organizing means 14 including the horizontally oriented support plate 18 with the array of holes 20 for supporting pipette tips 12 with their longitudinal axes vertically oriented and (2) a hand-gripable carrier 16 for the organizing means. The carrier 16, in turn, comprises (i) the cover 26 for confining the proximal end portions 24 of the array of pipette tips 12 and (ii) vertically extending side members 48 from marginal edges of the support plate secured at their upper edges by releasable latching means 28 to the cover 26.

To protect the distal end portions of the array of pipette tips 12 carried by the support plate 18, the refill pack 10 of FIG. *2a* may be enclosed in a film-like plastic pouch 58 secured, as by adhesive, at its open upper end to the side members 48 to enclose the refill pack.

The refill pack 10 is designed to dispense the array of pipette tips 12 into any pipette tip rack having rigid supports for the semi-rigid support plate 18 or a rigid horizontally extending pipette tip support tray having an array of holes corresponding to the spacing of the holes in the support plate 18. In such tip racks, the pipette tip support tray may extend even with a top of the tip rack container supporting the tray. Alternatively, the support tray may extend horizontally above or the top of the tip rack container for covering by a hinged cover for the tip rack or it may be recessed below the top of the container as shown in FIGS. *2b* and *3b*. Thus, it is by way of example only that the pipette tip rack 38 illustrated in FIG. *2b* into which the support plate 18 and array of pipette tips 12 is to be dispensed comprises a base 40 with equally vertically extending sides 42. The sides 42 are mutually attached at their contiguous edges and at the peripheral edges of the base 40 thereby forming an essentially rectangular container with an open top 44. Further, as shown in FIG. *2b*, the vertical sides 42 include vertically positioned inwardly projecting horizontal supports 46 or outwardly stepped supports 46 in the vertical sides 42 as shown in FIG. *3b*. The supports 46 provide horizontal support for a rigid plastic tip tray 47 including an array of holes 47' for receiving the distal end portions of the array of pipette tips contained in the rack 38. In the present invention, it is important that the array of holes 20 in the semi-rigid support plate 18 correspond to the array of holes 47' in the tray 47. Because of such correspondence of holes, when the support plate is positioned on the tray 47 as shown in FIG. *2b*, the distal end portions array of pipette tips 12 contained by the support plate 18 extend through corresponding holes 47' in the tip tray 47 into the rack 38 with ends spaced slightly from the base 40. Alternatively, the support for the plate 18 within the rack 38 may comprise outwardly stepped supports 46 in the vertical sides 42 as shown in FIG. *3b*.

More particularly, as shown in FIG. *2a*, the support plate 18 comprising the organizing means 14 contains an array of holes 20 permitting the distal end portions 22 of the pipette tips 12 to extend vertically therethrough. The holes 20 do not pass the proximal end portions 24 of the pipette tips 12 which extend vertically from the opposite side of the support plate 18. The support plate 18 thereby supports the pipette tips 12 with their longitudinal axes vertically oriented. The sides members 48 extend equally vertically upward from peripheral edges of the horizontal support plate 18 and are mutually attached along contiguous edges, thereby forming a dish-shape. The vertical dimension of the side members 48 slightly exceeds the dimension of the proximal end portion 24 of the pipette tips 12 forming a protective container 50. Each vertical side member 48 folds horizontally outward forming a continuous surrounding flange 52 for application of a lidstock 54, thereby vertically confining and protecting the proximal end portions 24 of the pipette tips 12. The lidstock 54 attaches to an upper surface of the flange 52 by heat bonding, adhesive, or mechanical means, thereby forming the releasable means 28 securing the cover 26 to the organizing means 14.

As previously disclosed, the refill pack 10 shown in FIG. *2a* is contained within the loose film pouch 58. The pouch 58 is attached to a lower surface of the flange 52 of the side members 48 by heat bonding, adhesive, or mechanical means to protectively cover the distal end portions 22 of the pipette tips 12. Further, the pouch 58 and cover 26, if sealed, form a container which may be filled with air or an inert gas at a pressure slightly greater than atmospheric for added protection of the distal end portions 22 of the pipette tips 12 during shipping, handling and storage.

In the use of the embodiment shown in FIG. *2a*, the loose film pouch 58 is removed from the refill pack 10 and the organizing means 14 is positioned in the tip rack 38 with the distal end portions 22 of the pipette tips 12 extending into the tip rack 38. The organizing means 14 is supported by the side member supports 48, thereby refilling the tip rack 38. The lidstock 54 is removed to allow access to the proximal end portion 24 of the pipette tips 12.

An alternative to the pipette tip refill pack 10 of FIGS. *2a* and *2b*, is shown in FIGS. *3a* and *3b* and comprises a refill pack with a planar support plate 18 and an inverted dish-shaped cover 26. The cover 26 comprises sides 48' extending vertically downward from peripheral edges of a horizontal top 27, joined at contiguous edges. The lower edge of each side 48' folds horizontally outward to form a continuous surrounding flange 52'. The flange 52' attaches to an upper peripheral surface of the planar support plate 28 by adhesive, thermal or mechanical means such as a clip, thereby forming a chamber to contain the proximal end portions 24 of the pipette tips 12. As in the embodiment of FIG. 2*a*, a pouch 58' for protecting the distal end portions 22 of the pipette tips 12 may be bonded to the lower peripheral surface of the support plate 18 with adhesive, thermal or mechanical means.

Figure 3A:
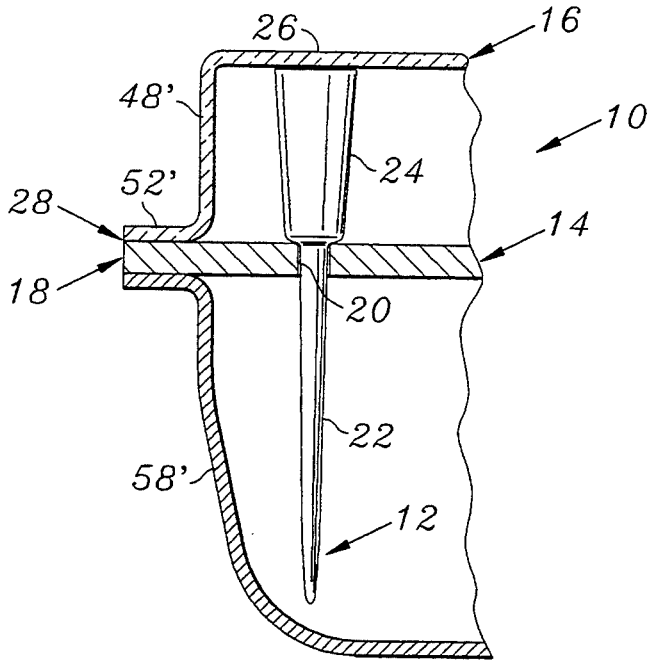
FIG. 3*a* is a partial section side view of a single array refill pack having a planar support plate for an array of pipette tips, a cover with sides having flanges resting on and releasably bonded to a top of the support plate, and a cover pouch over distal end portions of the pipette tips.
Figure 3B:
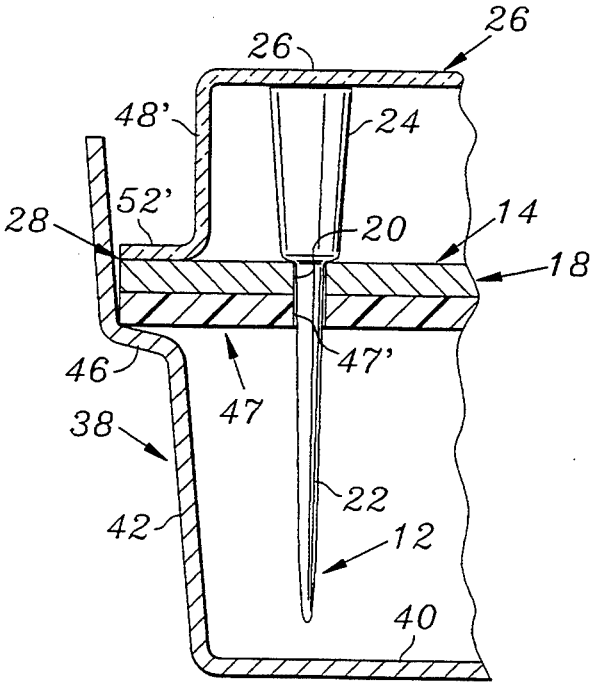
FIG. 3*b* is a partial section side view of a single array refill pack as shown in FIG. 3*a* with the pouch removed and the refill pack in position in a tip rack.

In the use of the embodiment as shown in FIGS. 3*a* and 3*b*, the loose film pouch 58' is removed from the refill pack 10 and the support plate 18 is positioned in the tip rack 38 to rest for support on the tray 47 with the distal end portions 22 of the pipette tips 12 extending through the holes 47' into the tip rack 38, thereby refilling the tip rack 38. Then, the cover 26 is removed, allowing access to the proximal end portions 24 of the pipette tips 12.

Figure 4A:
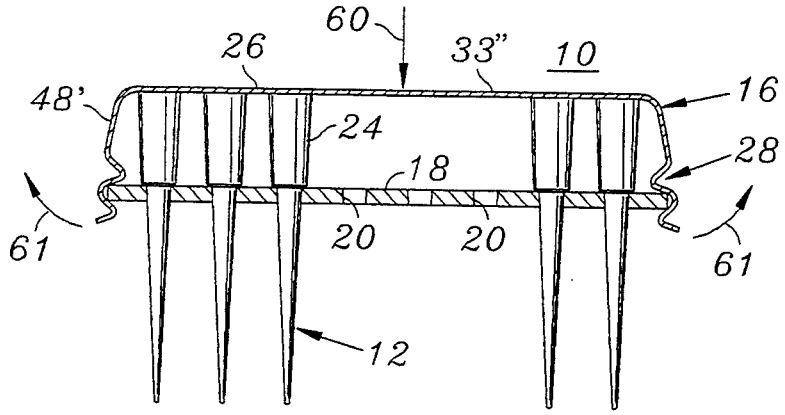
FIG. 4*a* is a full section end view of a single array pipette tip refill pack comprising a thin section flexible releasable cover over a pipette tip support plate.
Figure 4B:
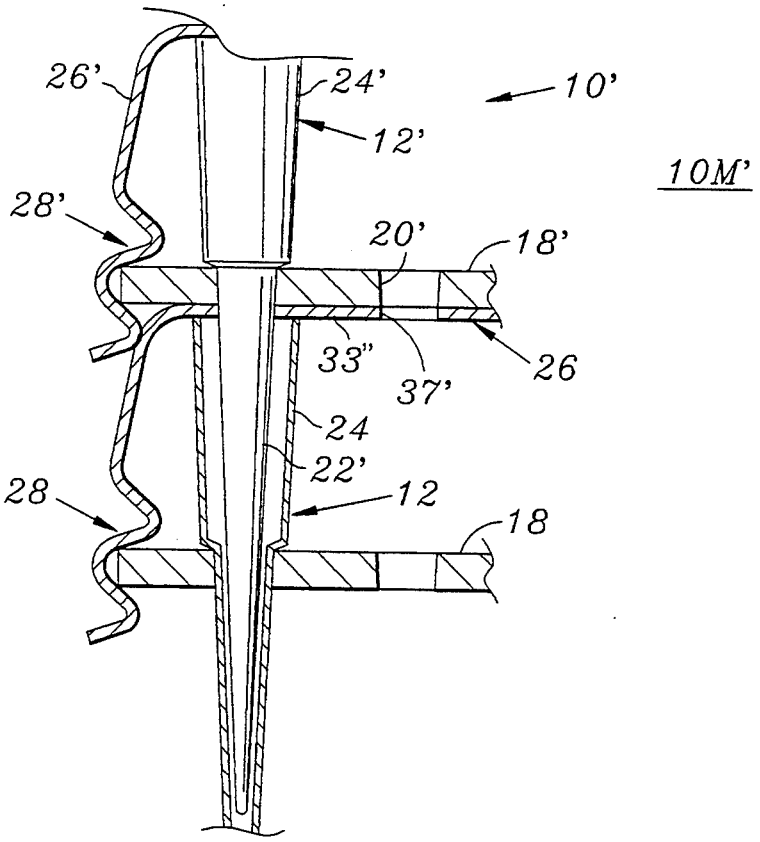
FIG. 4*b* is a partial section end view of nested pipette tips as contained in two stacked single array refill packs as shown in FIG. 4*a* but illustrating the use of openings in the cover coincident with openings in the support plate to permit the single array refill packs to be stacked in a space efficient manner.

As previously mentioned, FIGS. 4*a* and 4*b* depict preferred embodiments a single and a multiple array pipette tip refill pack of the present invention. As with refill packs previously described, the single array refill pack 10 of FIG. 4*a* comprises (1) the horizontally oriented support plate 18 with an array of holes 20 for supporting pipette tips 12 (including filter containing tips) with their longitudinal axes vertically oriented and (2) a hand-gripable carrier 16 comprising a cover 26 for confining the proximal end portions 24 of the array of pipette tips 12. In addition, the cover 16 comprises a releasable latching means 28 for releasably securing the support plate 18 relative to the cover 26.

More particularly, the cover 26 of FIG. 4*a* comprises a shallow container of light-weight thin flexible plastic material. As shown, the container includes a horizontally oriented semi-rigid inwardly flexible rectangular cover or alignment plate 33'' with outwardly flexible continuous side members 48' including the releasable latching means 28 for the support plate 18. In this regard, spaced slightly from an open bottom of the container comprising the cover 26, the continuous side members 48' include a continuous "S" shaped section defining a horizontal channel for receiving and releasably gripping marginal edges of the support plate 18. With the support plate 18 secured within the container, the cover plate 33'' is vertically displaced from the support plate by a dimension substantially equal to or slightly greater than the length of the proximal end portions 24 of pipette tips 12, thereby containing the proximal end portions between the cover plate and the support plate ready for dispensing from the refill rack 10.

Thus, in use, a user of the refill pack 10 of FIG. 4*a* grasps the container (comprising the cover 26 and carrier 16) and moves the open bottom of the container over the top of an empty tip rack with the distal end portions of the pipette tips extending into the rack. Then, as indicated by the arrows 60 and 61, he either presses downwardly on the top of the alignment plate 33'' or outwardly on the side members 48' to release the latching means 28 defined by the channel in the side members and allows the support plate to separate from the container and deposit with the array of pipette tips 12 into the tip rack. The container may then be recycled for future use.

As shown in FIG. 4*b*, the refill pack of FIG. 4*a* may be modified to accommodate a stacking of similar refill packs 10 and 10' with a nesting of arrays of conventional pipette tips into a space saving package. To accomplish such stacking, the alignment plate 33'' may include an array of holes 37', preferably corresponding to the array of holes 20 in the support plate 18. As shown, the holes 37' are dimensioned such that when a second refill pack 10' is stacked on the refill pack 10, the support plate 18' of the second refill pack rests on a top of the container comprising the cover 26 for the first refill pack. Thus arranged, corresponding ones of the distal end portions 22' of the array of pipette tips 12' carried by the support plate 18' extend through corresponding ones of the holes 37' and nest into corresponding proximal and distal end portions of corresponding ones of the pipette tips 12 to form a multiple array refill pack 10M'.

As with the single array refill pack 10 of FIG. 4*a*, the multiple array refill pack 10M' of FIG. 4*b* may be separately shrink wrapped or closed for shipping and storage in a thin plastic pouch or cardboard box. Thus, in use, the refill pack is first removed from the shrink wrap, pouch or box. Then, the user grasps the cover of the uppermost refill pack and lifts the pack from the stack. He then moves the refill pack over the top of an empty tip rack and dispenses the support plate and array of pipette tips from the cover in the manner previously described for the single array refill pack of FIG. 4*a*.

Figure 5A:
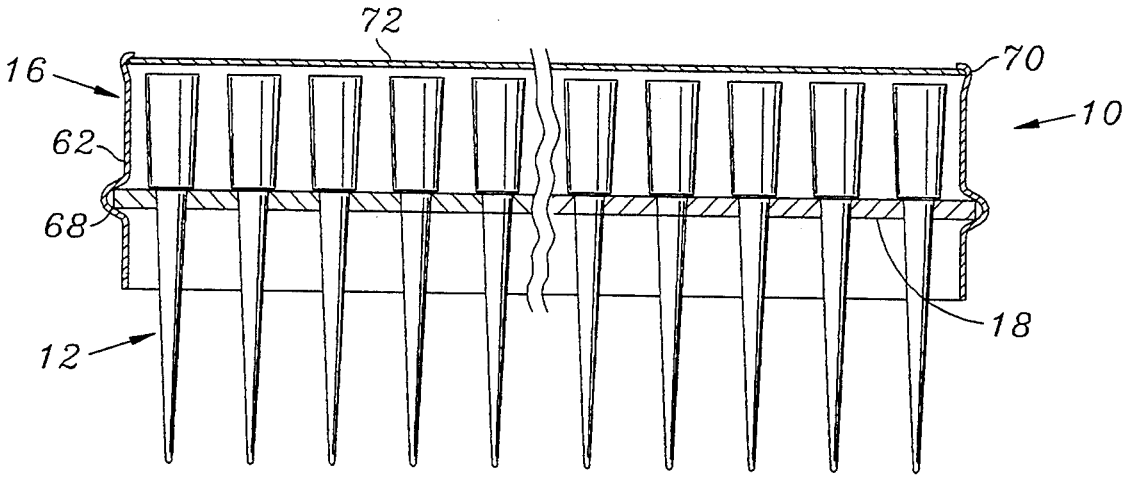
FIG. 5*a* is a shortened section side view of a single array pipette tip refill pack comprising a sleeve surrounding and releasably attached to a pipette tip support plate, the sleeve including an upper flange for retaining a cover over an array of pipette tips.
Figure 5B:
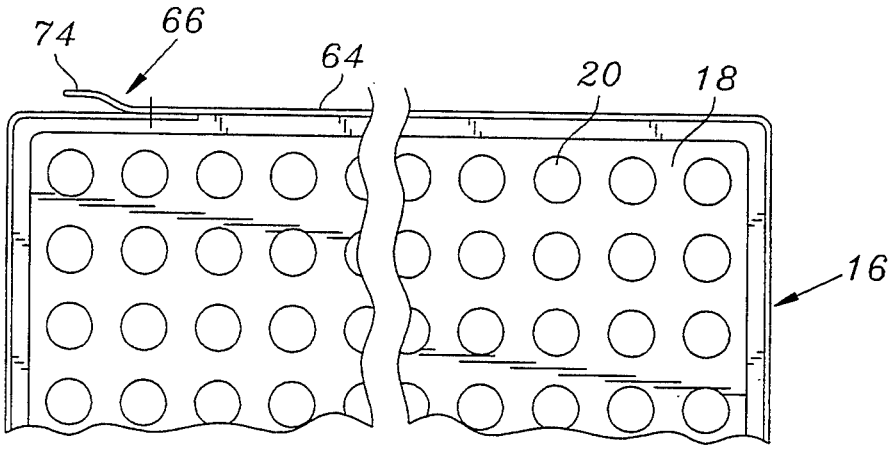
FIG. 5*b* is a partial top view of the refill pack of FIG. 5*a* with the cover removed to show the sleeve surrounding the support plate, a sleeve seam, a fastener and a tab on opposite ends of the sleeve for releasably removing the sleeve from the support plate.
Figure 6:
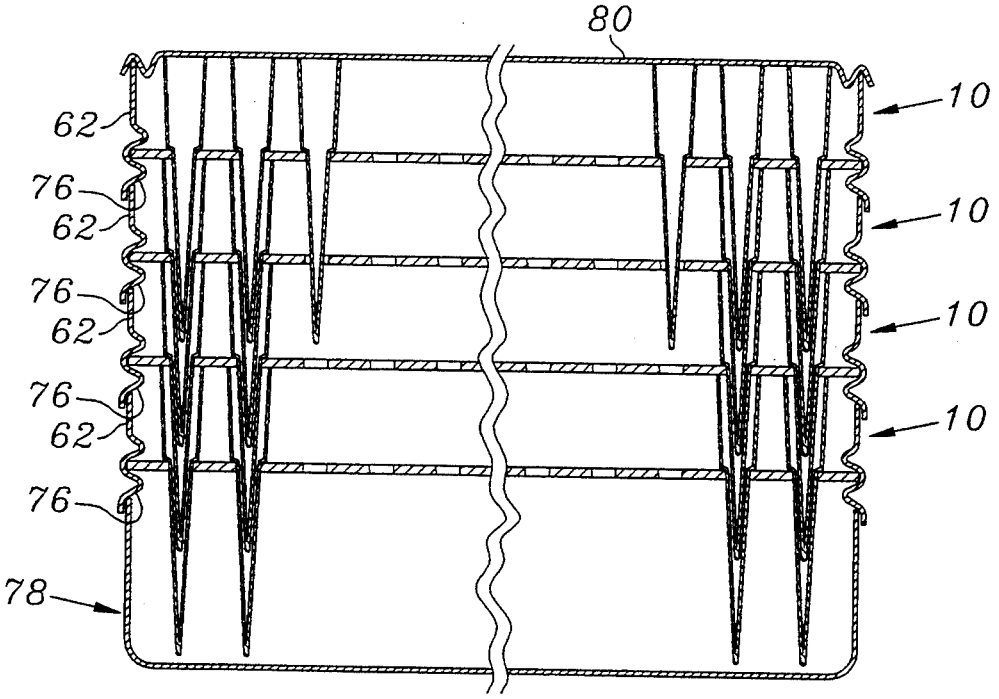
FIG. 6 is a shortened section side view of a covered set of nested single array refill packs similar to FIG. 5*a* resting on a base container, distal end portions of pipette tips in an uppermost array being concentrically contained within proximal end portions of a lower array of pipette tips.

Another simplified single array refill pack is depicted in FIGS. 5*a* and 5*b*, while FIG. 6 depicts a multiple array refill pack comprising a stack of single array refill packs similar to those of FIG. 5*a*. As shown in FIG. 5*a*, the single array refill pack comprises the previously described basic combination of (1) a support plate 18 with an array of holes carrying an array of pipette tips 12 (including filter containing pipette tips), and (2) a hand-gripable carrier 16 for hand moving the support plate over an open top of an empty tip rack and for separating from and dispensing the support plate and the array of pipette tips into the rack. In the embodiment shown in FIG. 5*a*, the carrier 16 comprises a hand gripable sleeve 62 surrounding and releasably securing marginal edges of the support plate 18. Preferably, the sleeve 62 is formed by a band 64 of flexible material having its opposite ends releasably secured by latching means 66. The band 64 is formed with a longitudinally extending channel adjacent 68 its lower edge such that when the band is wrapped around the support plate 18, the marginal edges of the support plate fit securely into the channel, defining a lower channel for releasably securing the support plate. The band also is formed along its upper edge with a longitudinally extending channel 70 which when the band is wrapped around the support plate defines an upper channel for receiving a removable top cover 72 for the refill pack.

FIG. 5*b* depicts the refill pack of FIG. 5*a* with the cover 72 removed and illustrates the array of holes 20 in the support plate 18 as well as the releasable latching means 66. As shown, the latching means 66 comprises a releasable connection between the opposite ends of the band 64 and a tab 74 extending from the outermost end of the band as wrapped around the support plate.

In use, the refill pack of FIGS. 5*a* and 5*b* is picked up by the user grasping the sleeve 62. The user moves the refill pack over an empty tip rack and positions the distal end portions of the array of pipette tips 12 in the tip rack. Then, grasping the tab 74, the user pulls on the band to release the latching means and separate the sleeve. This allows the top cover and the sleeve 62 to separate from the support plate 18 and the support plate and array of pipette tips 12 to seat in the tip rack.

As shown in FIG. 6, the basic refill pack of FIG. 5*a* may be modified to accommodate stacking of similar refill packs with a nesting of arrays of conventional pipette tips into a space saving package. To accomplish such stacking, the lowermost edge portion of the sleeve 62 of each refill pack is bent slightly outward and vertically downward to define an annular horizontal shoulder 76. Also, the upper edge portion of the sleeve is bent to extend vertically such that the lower open end of an upper sleeve will fit over an upper end of a lower sleeve. Thus positioned, the lateral shoulder 76 will rest upon a top edge of a lower sleeve as shown in FIG. 6. Accordingly, a stack of modified refill packs as shown in FIG. 6 will comprise a plurality of refill packs with the all but the bottom sleeve stacked such that the lower end of each sleeve rests on the top edge of the next lower sleeve and the distal end portion of each array of pipette tips nests into the proximal end portions of the next lower array. As illustrated, the bottom sleeve rests on a top edge of a bottom support container 78 for the stack and a top cover 80 snaps over the top edge of the sleeve of the upper refill rack to complete the stack. The stack of refill pack shown in FIG. 6 thus defines a self-contained package for storage. Of course, if desired, the package may be shrink wrapped or otherwise contained in another carton or container for shipping and storage.

Figure 7:
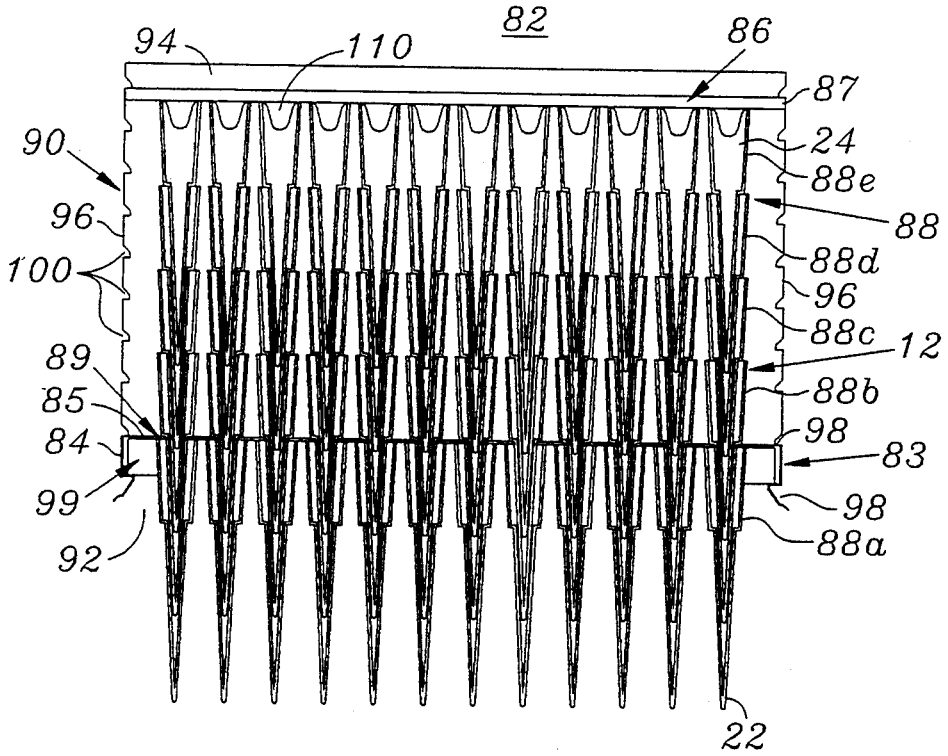
FIG. 7 is a side view of a transparent plastic multiple array refill pack with pipette tips telescoped, positioned in a support grid carrier plate and contained in a multiple dispenser thin-wall shell.
Figure 8:
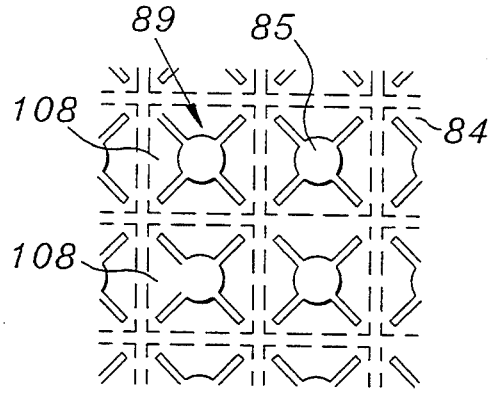
FIG. 8 is a detail partial top view of a punched sheet forming variable size holes for control of nested pipette tip release in the embodiment of FIG. 7.
Figure 9:
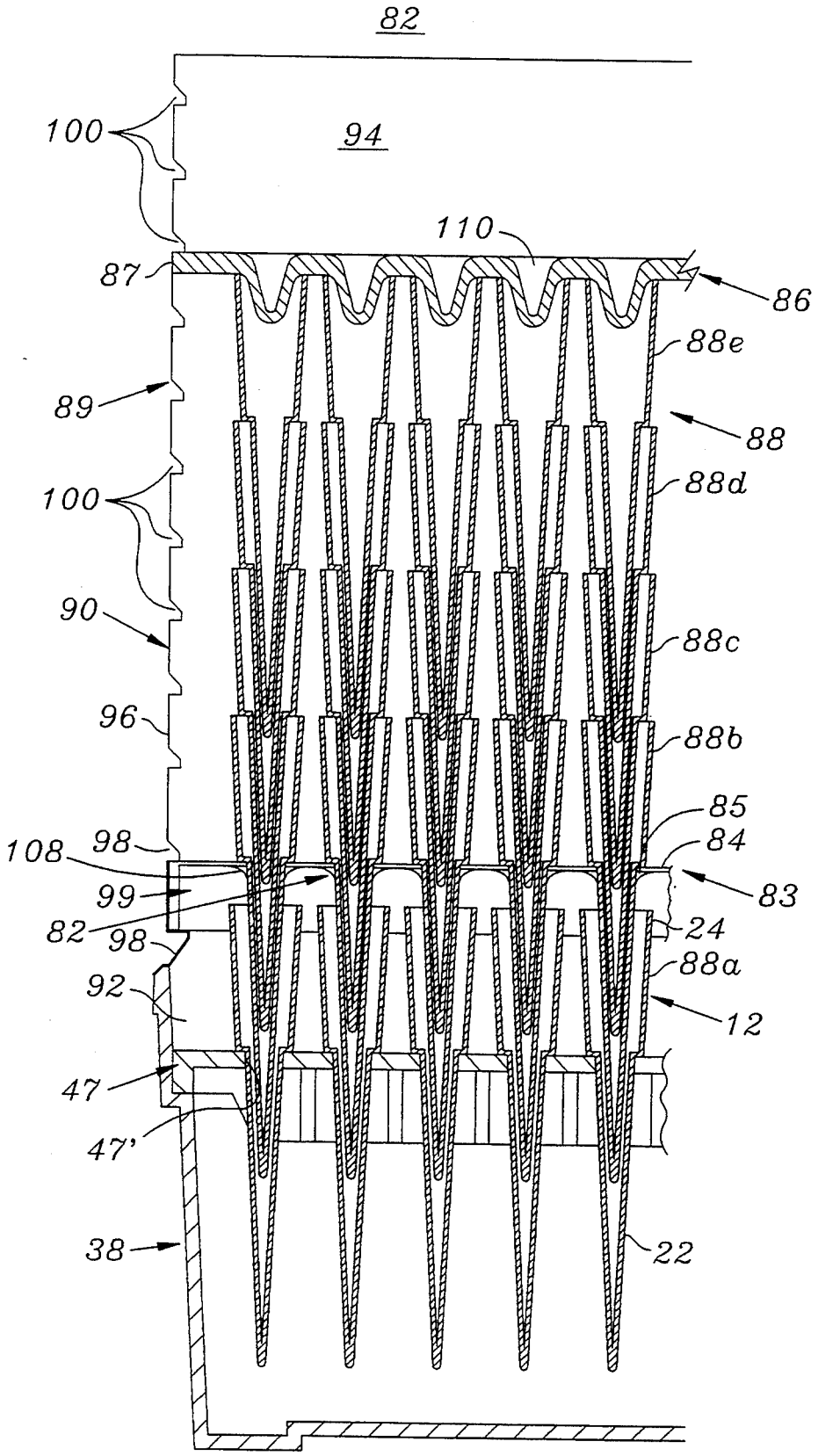
FIG. 9 is a partial side view, partially in section, of the embodiment of FIG. 7 positioned on a tip rack and showing operating features of the refill pack.

Another preferred embodiment of the present invention comprises the refill pack 82 for nested multiple arrays of pipette tips shown in FIGS. 7, 8 and 9. Refill pack 82 comprises (1) an organizing means 83 including a support plate 84 with an array of holes 85 vertically supporting pipette tips 12, (2) a cover 86 for confining the proximal end portions 24 of the uppermost pipette tips 12 and including a push plate 87, and (3) a releasable means 89 for releasably securing the proximal end portions 24 of the pipette tips 12 in the organizing means 83. Upon application of a downward force actuating the releasable means 89, a lowermost array of the pipette tips 12 drops vertically from the refill pack 82 into a tip rack, such as the rack 38 shown in FIG. 2*b*, containing a horizontally extending pipette tip organizing tray 47 with holes 47' for receiving and vertically supporting the pipette tips.

More particularly, as most clearly shown in FIGS. 7 and 9, the refill pack 82 vertically separates arrays 88*a–e* of horizontally spaced pipette tips 12 telescopically stacked within the pack with distal end portions 22 of pipette tips 12 in the lowermost array 88*a* extending downward through the holes 85 in the horizontally oriented support plate 84. The distal end portions 22 of the pipette tips 12 in the next lowermost array 88*b* telescope into the proximal end portions 24 of the pipette tips 12 in the array 88*a* while distal end portions 22 of the pipette tips 12 in the array 88*c* telescope into the proximal end portions 24 of the pipette tips 12 in the array 88*b* and so on up to the array 88*e*, all as shown in FIGS. 7 and 9. As depicted, each pipette tip 12 in each of the arrays 88*a–e* is equally displaced in a vertical direction from a similarly placed tip 12 in an adjacent vertical stack so as to create equally spaced layers of arrays.

In the refill pack 82, the proximal end portions 24 of the uppermost pipette tips 12 engage the cover 86 comprising the horizontally oriented push plate 87 within a reusable four sided tubular container 90. The container 90 may be formed of a light weight plastic and is dimensioned to receive and capture the horizontal support plate 84 of the organizing means 83 at a lower open end 92 and to receive the push plate 87 at an upper open end 94 of the container 90. Opposing sides 96 of the tubular container 90 are essentially rectangular, parallel, vertically oriented and mutually attached at contiguous edges thereby enclosing an essentially rectangular volume. The sides 96 include vertically spaced and horizontally extending inward projections 98 positioned to constrain and position the organizing means 83 with marginal edges within a channel 99 adjacent to the lower opening 92 of the container 90. Thus positioned, the support plate 84 places the pipette tips 12 of the lowermost array 88*a* with distal end portions 22 of the pipette tips 12 extending downward through the array of holes 85 in the support plate 84 for protection within the lower end of the container 90. Additional inward projections 100 in the sides 96 of the container 90, comprise horizontally separated, vertical series of triangularly shaped ramps, spaced at equal intervals vertically above the support plate 84 to permit downward incremental movement of the push plate 87 and prevent an upward return movement. The distance of the downward incremental movement of the push plate 80 thereby affects a sequential releasing of the lowermost one of the arrays 88 of pipette tips 12 from the telescoped vertical stack of pipette tips 12 through the holes 85 in the support plate 84 into the holes in a tray 47 in the pipette tip rack 38 (FIG. 2*b*) and a positioning of the distal end portions 22 of the next lowermost array of pipette tips 12 in the holes 85 for subsequent release.

As previously stated, the refill pack 82 may be provided commercially in a package on top of an empty tip rack, such as 38, and secured thereto by a removable band surrounding a junction between the sides 96 and the tip rack. Alternatively, the refill pack may be covered with shrink wrap or the open end of the refill pack may be closed by a removable sheet of lidstock.

As shown in FIGS. 8 and 9, the releasable means 88 for releasably securing the pipette tips 12 relative to the cover 86 comprises the series of inward projections 100 for engaging the push plate 87 as already described and moveable means 108 extending into the holes 85 of support plate 84 to define enlargable openings for receiving and holding the distal end portions 22 of the lowermost array 88*a* of pipette tips 12. The moveable means 108 receive and enlarge to pass the proximal end portions 24 of the lowermost array 88*a* of pipette tips 12 and to dispense the array 88*a* into the tip rack 38 with a downward movement of the arrays 88*a–e* in response to corresponding downward movement of the push plate 87 against the proximal end portions 22 of the uppermost array 88*e* of the pipette tips. Following the passage and release of the proximal end portions 22 of the array 88*a* of pipette tips 12, the moveable means 108 extending into each hole 85 returns to its smaller dimension to accept the distal end portions 22 of the next lowermost array 88*b* of telescoped pipette tips 12 as they descend into a dispensing position. The foregoing dispensing operation may then be repeated for the array 88*b* and so on until all of the arrays of pipettes are dispensed by the refill pack into pipette tip racks.

As previously noted, the cover 86 as shown in FIGS. 7 and 9 comprises the horizontally oriented rigid push plate 87. As shown, the push plate preferably includes a plurality of spaced indexing means 110 fitting into the proximal end portions 24 of uppermost array 88*e* of pipette tips 12. The spaced indexing means 110 may take the form of indentations with the center of each indentation coincident with the center of identically located holes 85 arrayed in the support plate 84. Such an arrangement maintains the longitudinal axes of the stack pipettes forming arrays 88*a–e* in vertical alignment within the container 90 for successive release of the lowermost ones of the pipette tip arrays into .the pipette tip tray 47 of the rack 38 as described above.

Figure 10:
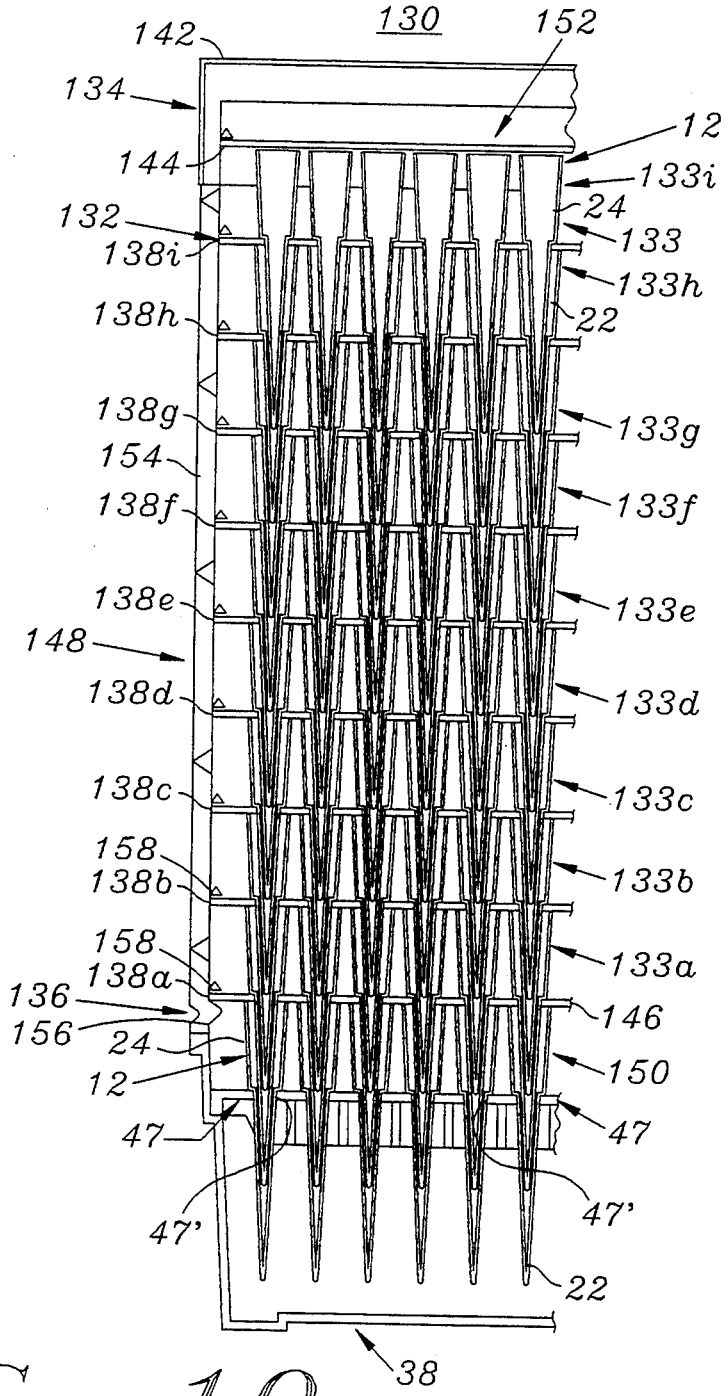
FIG. 10 is a partial side view of an second transparent plastic multiple array refill pack with pipette tips positioned in single array carrier plates stacked and contained in a multiple dispenser thin-wall shell shown on a tip rack.
Figure 11:
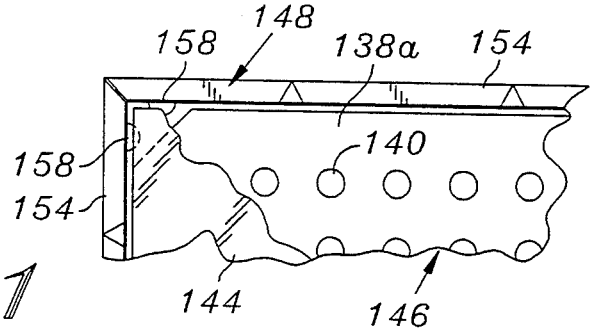
FIG. 11 is an enlarged top view, partially cut away, of a corner of a push plate and carrier plate in the embodiment of FIG. 10.

As previously noted, the third preferred embodiment of the present invention comprises a stacked multiple array refill pack 130 as shown in FIGS. 10 and 11. Generally speaking, the refill pack 130 resembles the refill pack 82 of FIGS. 7–9 and comprises a vertical tubular container 148 forming a basic element of a cover 134 for the refill pack 130. As illustrated, the container 148 may be formed of a thin light weight plastic material and houses (1) an organizing means 132 including carrier plates (138*a–i*), each with an identical array of holes 140 corresponding to the array of holes in the organizing tray of the tip rack and each supporting an array (133*a–i*) of pipette tips 12, (2) the balance of the cover 134 comprising a removable cover 142 and a push plate 144, and (3) a releasable means 136 releasably securing the organizing means 132 relative to the cover 134.

As shown in FIG. 10, when the container 148 is positioned over the tip rack 38, the distal end portions 22 of a lowermost array 133*a* of pipette tips 12 extend into corresponding holes in the organizing tray 47. When so positioned, actuation of the releasable means 136 releases the lowermost carrier plate 138*a* containing the array 133*a* into the tip tray 47 thereby refilling the pipette tip rack 38. Once the rack 38 has dispensed the array 133*a* onto single or multiple-tip pipettes, the foregoing operation may be repeated to again refill the rack 38 with the next lowermost array 133*b* of pipette tips 12, and so on. In the dispensing of pipette tips from the tip rack 38, structural support for the carrier plates 138 is provided by the tip rack 38. For that reason, the carrier plates may be formed of a thin light weight semi-rigid plastic material which upon disposal represents a minimum of non-biodegradable waste.

More particularly as shown in FIG. 10, each of the plurality of horizontally oriented carrier plates 138*a–i*, has an array of holes 140 corresponding to the array of holes 47' in the organizing tray 47 of the tip rack 38. Each hole 140 receives a distal end portion 22 of a disposable pipette tip 12 which extends vertically downward therethrough with the proximal end portion 24 of the tip extending vertically upward therefrom. Thus, the carrier plates 138*a–i* position the arrays 133*a–i* of pipette tips 12 with the longitudinal axis of each tip having a vertical orientation. The plurality of carrier plates 138*a–i* are stacked in the container 148 with the distal end portions 22 of pipette tips 12 of the array 133*i* in the uppermost carrier plate 138*i* extending within the proximal end portions 24 of pipette tips 12 of the array 133*h* supported by the next lower carrier plate 138*h* and so down to the lowermost carrier plate. In such a nesting arrangement for the pipette tips, the upper carrier plate 138*i* rests on top of the proximal end portions 22 of pipette tips 12 of the array 133*h* in the carrier plate 138*h* while the carrier plate 138h rests on top of the proximal end portions of the pipette tips 12 of the array 133*g* in the carrier plate 138*g* and so on down to the lowermost carrier plate. Thus arranged, the lowermost carrier plate 138*a* becomes a support plate 146 when it is positioned against the releasable means 136 for releasably restraining the support plate 146 relative to the cover 134.

As illustrated, the cover 134 comprises the container 148, the removable cover 142 and the push plate 144. The cover 142 encloses an open upper end 152 of the container 148 and covers the open upper end of the tip rack 38 when it is separated from the refill pack 130. The push plate 144 resides in the container 148 at the upper open end 152 and rests on the proximal end portions 22 of the pipette tips 12 in the array 133*i*. When external downward force is applied to the push plate 144, it moves downward pressing against the uppermost array 133*i* of pipette tips 12 to transmit the force through the arrays 133*a–h* to the lowermost array 133*a*. Each carrier plate 138*a–i* sequentially moves downward, becoming the support plate 146 and is ejected by action of the indexed downward movement of the push plate 144 against the proximal end portion 34 of the array 133*i* of pipette tips 12 within the refill pack 130.

In the refill pack 130, the releasable means 136 is part of the four sided tubular container 148. As shown, the container the four sided tubular container 148. As shown, the container 148 is dimensioned (i) to receive, support and transport the horizontal carrier plates 138*a–i*, each sequentially into position as the support plate 146 at a lower open end 150 of the container 148 and (ii) to receive the push plate 144 at the upper open end 152 of the container 148 after the removal of the cover 142. Opposing sides 154 of the tubular container 148 are essentially rectangular, parallel, vertically oriented and mutually attached at contiguous edges thereby enclosing an essentially rectangular volume. The sides 154 include vertically positioned and horizontally extending inward projections 156 for releasably supporting and positioning the support plate 146 marginal edges within the lower opening 150 of the container 148.

As shown in FIG. 11, additional inward projections 158 in corners of the sides 154 of the container 148, comprise horizontally separated series of triangular shaped ramps, spaced at equal intervals vertically above the support plate 146 so as to permit incremental downward movement of the push plate 144 and prevent an upward return movement thereof. As shown in FIG. 11, the inward projections 158 are positioned to constrain only the movement of the push plate 144 by contact with the corners thereof. As illustrated, bevelled corners of the carrier plates 138*a–i* do not permit the inward projections 158 to contact the peripheral edges of carrier plates 138*a–i*. The incremental downward movement of the push plate 144 thereby affects sequential releasing of the lowermost array 133*a* of pipette tips 12 contained in the carrier plate 138*a* to drop into the tip rack 38 and positioning the next lowermost carrier plate 138*b* as the support plate 146 for subsequent release. Release of the carrier plate 138*a* results from the downward pressure of the push plate 144 applied against the proximal end portions 24 of the uppermost array 133*i* of pipette tips 12 and thereby against the carrier plate 138*i* and thereafter through the arrays 133*a–h* of pipette tips and carrier plates 138*b–h*. The downward pressure of the carrier plate 138*a* against the indentations 156 causes sides 154 to flex outward slightly, for releasing the carrier plate 138*a* into the tip rack below.

In the embodiments of the present invention shown in FIGS. 7–11, it is an important feature in dispensing the pipette tips 12 that the arrays are dispensed one at a time. Further, when the refills packs are combined with pipette tip racks within a wrapped package as previously described, it is important that the arrays of pipette tips be secure and not subject to excessive movement relative to their supportive housings. To achieve such important objectives, the dimensioning of the refill packs relative to the tips racks is such that when an array of pipette tips is seated in the tip rack either by preloading as part of a combination package with a refill pack, or after a lowermost array of pipette tips has been dispensed from a refill pack into a previously empty tip rack, the pipette tips in the tip rack and the supporting tip rack tray form a hard stop for the stacks of arrays of pipette tips above the tip rack preventing downward movement of the stacked arrays. In the embodiments of FIGS. 7–9, the vertical stacking of pipette tips is such that an outer surface of the proximal end portions of each tip (except a lowermost tip) bears on and is supported by an upper end of the proximal end portion of a next lower tip. Thus, when the pipette tips supported on a tip rack tray and the tray establish a hard stop, a downward force on the vertical stacks will not produce a corresponding downward movement or a dispensing of an array of pipette tips by the refill pack. Likewise, in the embodiment of FIGS. 10 and 11, the carrier plates 138*b–i* each rest on a top of a proximal end portion of a next lower array of pipette tips 12 and the carrier plate 138*a* rests on a top of the pipette tips supported by the tip rack tray 47. Thus, when the pipette tips supported by the tray and the tray combine to form a hard stop, a downward force on the vertical stacks will not produce a corresponding downward movement or a dispensing of an array of tips by the refill pack. In these regards, in FIGS. 9 and 10, for purposes of clarity in illustrating the support plates 83 and 146, the bottoms of the support plates are shown spaced from the tops of the proximal end portions 24 of the pipette tips 12 supported in the tip rack 38. To prevent inadvertent downward movement of the stacked arrays of pipette tips relative to the array of tips in the tip rack, the dimensioning of the refill packs is such that the top of the proximal end portions of the tips in the tip rack engage or are very closely spaced from the under surface of the support plates to combine with the tip rack tray to provide the desired hard stop.

From the foregoing description of the various preferred embodiments illustrated in the drawings, it should be appreciated that the present invention may take many various forms and that the present invention is to be limited only by the following claims.

We claim:

1. For use with an empty reusable pipette tip rack including an open top and side support members extending vertically from a base support surface for the rack to vertically receive and horizontally position an array of pipette tips within the rack, a refill pack comprising:

a plurality of pipette tips;

pipette tip organizing means for vertically supporting the pipette tips in a horizontally spaced array, the organizing means being free of vertical support structure capable of engaging the base support surface for the tip rack when the organizing means is supporting the pipette tips;

hand-gripable carrier means secured to the organizing means for hand positioning the array of pipette tips over the open top of the empty pipette tip rack; and releasable means engaging the organizing means for downwardly dispensing the array of pipette tips from the carrier means into the empty pipette tip rack.

2. The refill pack of claim 1, wherein:

the pipette tips each include a proximal end portion and a distal end portion; and the pipette tip organizing means comprises a separate support plate having an array of holes therethrough for each receiving a distal end portion of one of the pipette tips to support and organize the pipette tips in the horizontally spaced array.

3. The refill pack of claim 2 wherein the releasable means comprises means on the support plate for selectively releasing the array of pipette tips through the holes in the support plate for dispensing into the empty rack in response to a downward force on the array of pipette tips.

4. The refill pack of claim 3 wherein the releasable means comprises moveable means in the holes in the support plate for enlarging the holes to dispense the array of pipette tips through the holes in response to a downward force on the array of pipette tips.

5. The refill pack of claim 2 wherein:

the carrier means comprises a cover for confining the proximal end portions of the pipette tips in combination with the support plate; and the releasable means comprises means for (1) securing the organizing means including the support plate relative to the cover and (2) selectively releasing the support plate and the array of pipette tips from the carrier means to affect a refilling of the empty pipette tip rack when placed under the refill pack.

6. The refill pack of claim 5 wherein the releasable means includes releasable latching means between the support plate and the cover.

7. The refill pack of claim 6 wherein the cover comprises an alignment plate for the array of pipette tips.

8. The refill pack of claim 7 wherein the alignment plate carries an array of indexing means for extending into proximal end portions of the pipette tips to perpendicularly align the tips with the holes in the support plate and to laterally secure the pipette tips on the support plate.

9. The refill pack of claim 7 wherein the releasable latching means comprises a length of tape releasably securing the alignment plate to the support plate.

10. The refill pack of claim 7 wherein the releasable latching means comprises spring-loaded attaching means.

11. The refill pack of claim 7 wherein:

the support plate comprises a first support plate, the array of pipette tips comprises a first array of pipette tips and the alignment plate includes an array of holes corresponding to the array of holes in the support plate for receiving distal ends of a second array of [pipettes]pipette tips supported on a second support plate for the nesting of the first and second arrays of pipette tips and stacking of a second refill pack thereon.

12. The refill pack of claim 11 further including means extending downwardly from the alignment plate around the holes in the alignment plate to extend into the proximal end portions of the pipette tips between the alignment plate and the first support plate to vertically align the first array of pipette tips with the holes in the first support plate and to horizontally secure the first array of pipette tips on the first support plate.

13. The refill pack of claim 5 wherein the cover and the releasable means comprise a flexible plastic cover having an inwardly flexible top over the proximal ends of the pipette tips and an open bottom defined by outwardly flexible sides extending from the top to surround and releasably engage and secure the support plate within the cover, whereby an inward force on the top will inwardly flex the top to press on the proximal ends of the pipette tips or an outward force on the side will outwardly flex the sides to release the support plate and array of tips from the carrier means through the open bottom of the cover.

14. The refill pack of claim 13 wherein the sides of the cover include a channel for receiving a marginal edge of the support plate to releasably support the support plate within the cover.

15. The refill pack of claim 13 wherein:

the support plate comprises a first support plate, the array of pipette tips comprises a first array of pipette tips and the top of the cover includes an array of holes corresponding to the array of holes in the first support plate for receiving distal end portions of a second array of pipette tips carried by a second support plate for nesting of the first and second array of pipette tips and a stacking of a second refill pack thereon.

16. The refill pack of claim 2 wherein the carrier comprises a hand-gripable sleeve releasably receiving and surrounding the support plate.

17. The refill pack of claim 16 wherein the sleeve comprises a band of flexible material having opposite ends secured by releasable latching means,

18. The refill pack of claim 17 wherein the band includes a longitudinally extending lower channel for receiving a marginal edge of the support plate to releasably secure the support plate within the sleeve defined by the band as it wraps around and surrounds the support plate.

19. The refill pack of claim 18 wherein the band includes an upper channel for receiving a marginal edge of a top cover to releasably secure the top cover over the proximal end portions of the array of the pipette tips carried by the support plate.

20. The refill pack of claim 16 wherein:

the support plate comprises a first support plate, the array of pipette tips comprises a first array of pipette tips and the hand-gripable sleeve comprises a first hand-gripable sleeve and the refill pack further includes:

a second support plate resting on the proximal end portions of the first array of pipette tips and having an array of holes there through for each receiving a distal end portion of a pipette tip to vertically support and organize a second array of pipette tips;

the second array of pipette tips with distal end portions extending vertically through the holes in the second support plate to nest in corresponding ones of the pipette tips of the first array with proximal end portions extending vertically above the second support plate; and a second hand-gripable sleeve releasably receiving and surrounding the second support plate above the first hand-gripable sleeve.

21. The refill pack of claim 20 further including a lid releasably secured to a top of the second hand-gripable sleeve to cover the proximal end portions of the second array of pipette tips.

22. The refill pack of claim 11 further comprising:

a second support plate resting on the alignment plate and having an array of holes there through corresponding to the holes in the alignment plate, each hole in the second support plate receiving a distal end portion of a pipette tip to vertically support and organize a second array of pipette tips;

a second array of pipette tips with distal end portions extending vertically through the holes in the second support plate to nest in corresponding ones of the pipette tips in the first support plate and with proximal end portions extending vertically above the second support plate;

a second alignment plate over and covering the proximal end portions of the second array of pipette tips; and second releasable latching means between the second alignment plate and the second support plate.

23. The refill pack of claim 15 wherein the cover comprises a first cover and, wherein the refill pack includes:

a second support plate resting on the top of the cover and having an array of holes there through corresponding to the array of holes in the top of the cover, each hole in the second support plate receiving a distal end portion of a pipette tip to vertically support and organize a second array of pipette tips;

a second array of pipette tips with distal end portions extending through the holes in the second support plate to nest in corresponding ones of the pipette tips in the first array and with proximal end portions extending above the second support plate; and a second flexible plastic cover having an inwardly flexible top over the proximal ends of the second array of pipette tips and an open bottom over the top of the first cover and having outwardly flexible sides extending from the top of the second cover to define the open bottom and to surround and releasably engage and secure the second support plate within the second cover.

24. The refill pack of claim 2 wherein:

the array of pipette tips comprises an array of horizontally spaced vertical stacks of tips, each stack containing a plurality of pipette tips with all but a lowermost one of the tips telescoping into a next lower tip in the stack and the lowermost tip in each stack extending into a hole in the support plate for support thereby; and the releasable means comprises a tubular housing dimensioned to (1) receive and horizontally support the support plate in the housing with the vertical stacks of pipette tips therein and (2) receive at an upper open end of the housing, and means for pushing downward on an uppermost end of proximal end portions of the pipette tips in each of the vertical stacks to affect a sequential release of lowermost pipette tips in the vertical stacks into an empty pipette tip rack.

25. The refill pack of claim 24 wherein the housing includes first stop means for securing the support plate within the housing and the support plate includes moveable means extending into the holes to define enlargable openings for receiving and holding the distal end portions of the lowermost pipette tips of the vertical stacks and for enlarging to receive and pass the proximal end portions of the lowermost pipette tips as the tips move downward in the housing a downward force on the upper ends of the pipette tips in the vertical stacks for release from the refill pack into the tip rack.

26. The refill pack of claim 25 further including a push plate for exerting the downward force on the upper ends of the pipette tips in the vertical stacks and wherein the housing includes vertically spaced detent means along opposing inner walls thereof for allowing downward movement of the push plate into the housing and for preventing upward return movement of the push plate in the housing.

27. The refill pack of claim 25 wherein the push plate carries a plurality of spaced indexing means fitting into the proximal end portions of the uppermost pipette tips in the vertical stacks.

28. The refill pack of claim 24 further comprising:

a pipette tip rack including a horizontally extending rigid pipette tip supporting tray having an array of pipette tip supporting holes corresponding to the array of holes in the support plate; and an array of pipette tips supported by the tray and including proximal end portions receiving distal end portions of lowermost ones of the pipette tips in the vertical stacks extending through the support plate; and a lower surface of the support plate resting on or closely spaced from upper ends of the proximal end portions of the pipette tips supported by the tip support tray.

29. The refill pack of claim 24 or claim 28 wherein the pipette tips comprising each of the vertical stacks are substantially equally vertically spaced to define a plurality of vertically separated arrays of pipette tips and wherein the refill pack further comprises pipette tip carrier plates for carrying each vertically separated array of pipette tips, each carrier plate extending horizontally within the housing with distal end portions of the pipette tips carried thereby extending through holes in the carrier plate and with proximal end portions of the pipette tips carried thereby extending vertically above the carrier plate and each carrier plate resting on a top of the proximal end portions of the next lower array of pipette tips whereby the support plate forming a first carrier plate and sequentially thereafter the other carrier plates are successively ejected with the lowermost pipette tips from the housing upon a downward movement of the vertical stack of pipette tips within the housing.

* * * * *